US005159987A

United States Patent [19]

Thorp et al.

[11] Patent Number: 5,159,987

[45] Date of Patent: Nov. 3, 1992

[54] VALVE CONSTRUCTION FOR AUTOMATIC SHUT-OFF SCREWDRIVERS AND THE LIKE

[75] Inventors: Phil D. Thorp, Bryan; Stephen F. Sims, Ney, both of Ohio

[73] Assignee: The Aro Corporation, Bryan, Ohio

[21] Appl. No.: 766,782

[22] Filed: Sep. 27, 1991

[51] Int. Cl.[5] ..... B25B 23/145

[52] U.S. Cl. ..... 173/176; 173/178; 81/470

[58] Field of Search ..... 173/176, 177, 178, 179, 173/180, 181, 182, 183, 5; 81/467, 469, 470, 473, 476, 477

[56] References Cited

U.S. PATENT DOCUMENTS

| | | | |
|---|---|---|---|
| 3,195,704 | 7/1965 | Linsker | 173/176 |
| 3,477,521 | 11/1969 | Kiester et al. | 173/176 |
| 3,821,991 | 7/1974 | Alexander | 173/180 |
| 3,970,151 | 7/1976 | Workman, Jr. | 173/176 |
| 4,492,146 | 1/1985 | Workman, Jr. | 173/177 |
| 4,535,850 | 8/1985 | Alexander | 173/176 |
| 4,813,492 | 3/1989 | Biek | 81/470 |

*Primary Examiner*—Frank T. Yost
*Assistant Examiner*—Scott A. Smith
*Attorney, Agent, or Firm*—Walter C. Vliet

[57] ABSTRACT

A valve construction for dual valve automatic and manual shut-off screwdrivers and the like wherein construction of the valve features both valve elements in a central axial bore having a unique valve block which is held in place by a screw in a transverse bore, the unique construction permits operation of the manual valve by a pin in the cross bore, aligns the stem of the manual valve, and permits ready access to the stem and valve of the automatic shut-off device as well as assembly of all of the components through access in a single longitudinal bore.

14 Claims, 2 Drawing Sheets

VALVE CONSTRUCTION FOR AUTOMATIC SHUT-OFF SCREWDRIVERS AND THE LIKE

BACKGROUND OF THE INVENTION

The invention relates generally to automatic shut-off screwdrivers and the like and more particularly to a means for manufacturing and assembling sequential valves accomplishing both manual and automatic shut-off of the screwdriver.

In general, a means to override the auto start - auto shut-off functions of a torque controlled, fluid power screwdriver or similar equipment is sometimes needed. This need is brought about by things like: manual alignment of screwdriver bit with driving means on screw head; correcting for cross-threading or misalignment of fastener in a tapped hole; and other emergency shut-off reasons. A convenient and economical means of production and assembly of the sequential valving is required.

The foregoing illustrates limitations known to exist in the present automatic screwdriver art. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a valve construction for automatic shut-off screwdrivers and the like comprising an elongated bore in the tool having disposed therein a first and second valve element accomplishing respectively manual and automatic shut-off of the tool; one of the valve elements cooperating and guided by a valve body removably disposed from a one end in the elongated bore for shutting off fluid flow in the elongated bore in one operating mode, and the valve body being secured in the elongated bore by a fastener in a cross bore intersecting the elongated bore; and the other of the valve elements cooperating with the other end of the bore to effect shut-off of fluid flow in the elongated bore in an alternative operating mode.

The foregoing and other aspects will become apparent from the following detailed description of the invention when considered in conjunction with the accompanying drawing figures.

BRIEF DESCRIPTION OF THE DRAWING FIGURES

FIG. 1 is a longitudinal cross section view illustrating an embodiment of the construction of an automatic screwdriver showing the detail of the valve construction according to the present invention; and FIG. 2 is a cross section of the automatic screwdriver according to the present invention taken at section 2—2 on Fig. 1 showing further details of a construction of the valve block.

DETAILED DESCRIPTION

The claims of this invention are in regard to the arrangement of manual valve and automatic shut-off valve being mounted within a common housing bore 50; means of air transfer from one valve to another; and the method used to bleed or purge fluid power supply chamber between the two valves.

Figure 2:
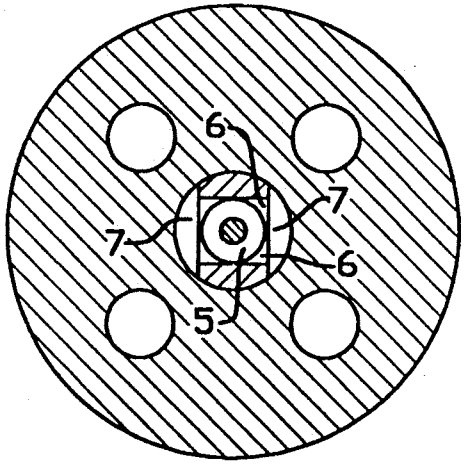

The attached illustration shows an adjustable, two-piece manually operated valve with stem 3 threaded and adjustable within valve body 2. The valve assembly is held closed by fluid power supply pressure and bias spring 4. To actuate the valve into an open position, an operator depresses the actuator pin 26, which is guided in bushing 22 and cooperates in a cross bore 51 in the valve block 24. This is accomplished either directly or by a lever means 40 as shown. As the pin 26 is pushed into the bushing 22, the ramp 27 displaces valve stem 3, which is guided in an axial bore 48 in valve block 24, and valve body 2 away from valve block 24. Fluid power supply can now pass from inlet to chamber 1, around valve body 2, into valve block chamber 5, through valve block slots 6, along chambers 7 (best seen in FIG. 2), into chamber 8 and then be blocked by valve body 9. Forward and reverse exhaust passageways are also shown in Fig. 2 but are not part of the novel construction of the present invention. Simultaneously, as actuator pin 26 is depressed into bushing 22, the vent passage 19 is moved away from hole 20 until the diameter of pin 26 seals fluid power supply from passing through hole 20, groove 21, passageway 23, chamber 25, silencer 41, and exhaust port 42, etc., to atmosphere. The manual override system is now in the "on" condition phase, awaiting the second phase actuation b the operator.

Figure 1:
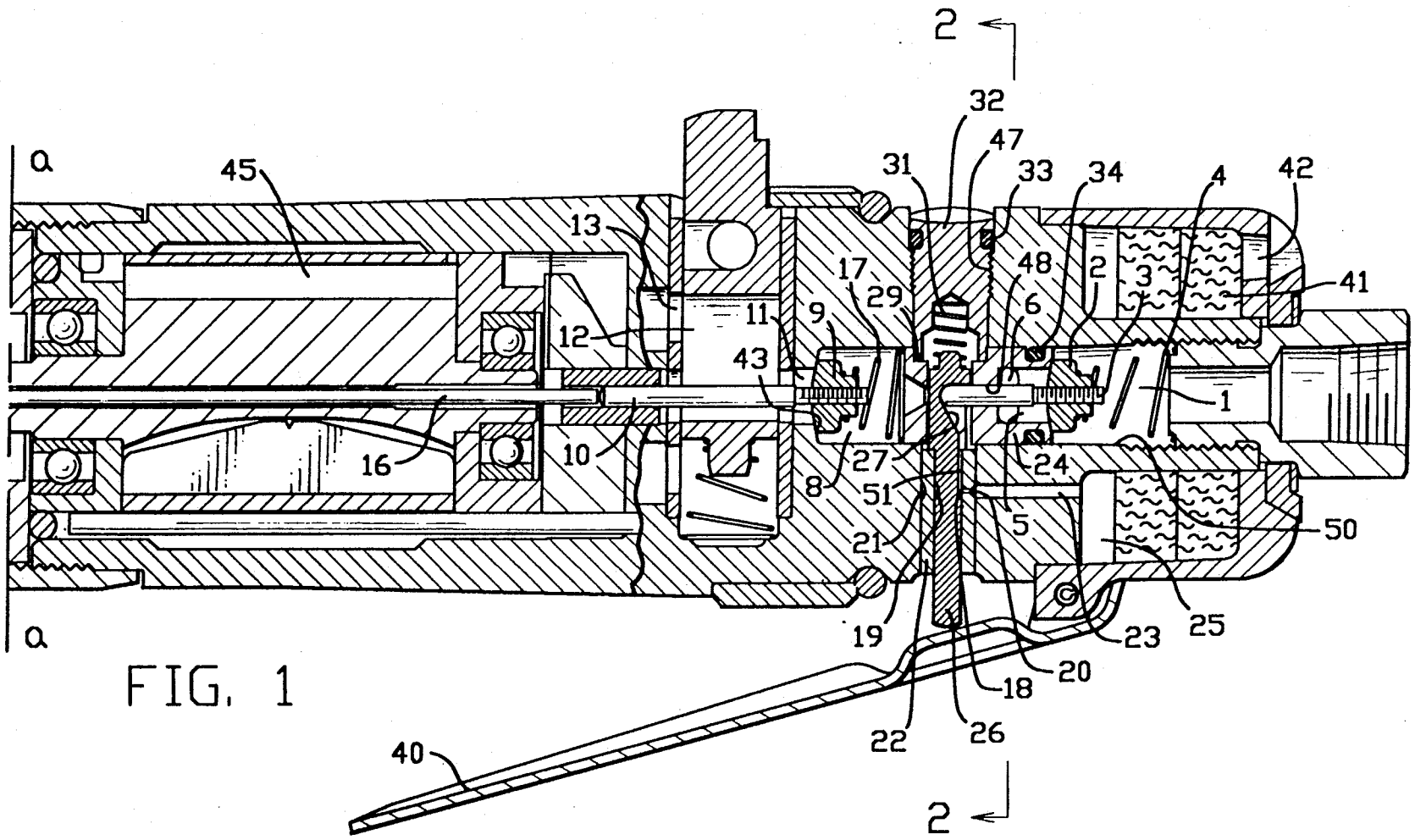
Figure 1A:
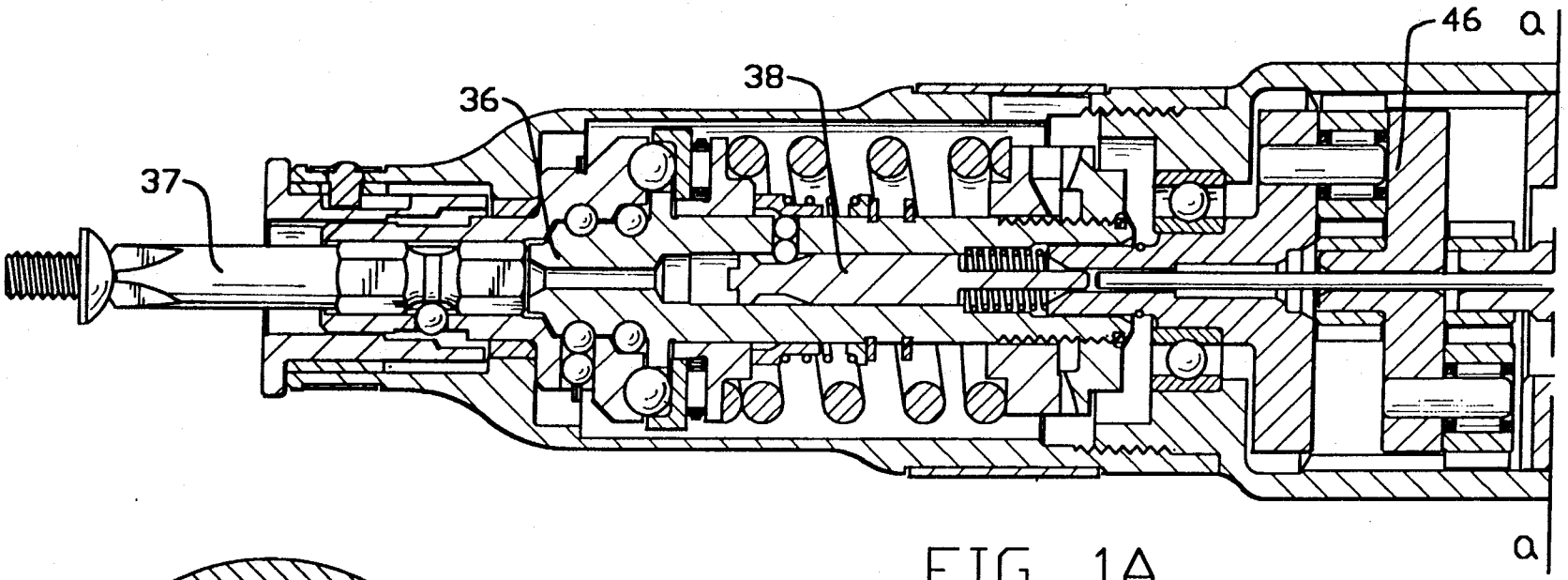

The second phase starts with the operator engaging the fastener with screwdriver bit and then pushing the tool towards fastener. The bit now axially moves the clutch assembly rearward, moving rod 16 against valve stem 10, having valve body 9 threaded onto and adjusted to be moved away from valve seat 43. Fluid power supply may now pass from chamber 8, around valve body 9, into chambers 11, 12, 13, and into the motor 45. The motor 45 is now operating to transmit power through the gearing 46, clutch 36, screwdriver bit 37, and finally to the fastener 38. Common construction features of the housing, motor, gearing and the like are shown on FIG. 1 but not otherwise described herein as they are readily understood by one skilled in the power tool art.

The normal cycle mode is to allow the motor to run until the resistant torque at the fastener exceeds a preset torque limit within the clutch assembly. The clutch 36 shown is generic of the type used to sense a preset torque limit, then actuate some components like cam pin 35 to allow rod 16, valve stem 10 with valve body 9 to move forward due to bias force of spring 17 and fluid power pressure force acting on valve body 9. When valve body 9 seats around port 11, fluid power supply to the motor has been cut off and motor quickly stops.

Abnormal or emergency conditions such as fastener cross-threading, etc., might require that the operator would want to interrupt the normal cycle mode. This is accomplished by the operator's release of the force maintaining valve pin actuator 26 to be depressed. The bias force from spring 31 in conjunction with bias force from spring 4 causes pin 26 to move out of bushing 22 and thereby allowing valve stem 3 to follow ramp 27 while moving forward until stopped when shoulder on pin 26 hits bushing 22. The valve body 2 is now seated against valve block 24. Fluid power supply is now blocked in chamber 1 by body 2 and seal 34 and motor quickly stops.

Concurrent with the valve actuator pin 26 moving out of bushing 22, groove 19 has aligned with hole 20 and permits high pressure fluid power supply to be exhausted from chambers between valve bodies 9 and 2 via slot 18, groove 19, hole 20, hole 23, chamber 25, etc., to atmosphere. This function is desirable to prevent a balance of forces occurring that could keep valve body 2 in a "passing" position of fluid power supply.

It should now be apparent to one skilled in the art that with the first phase valve control, an operator can engage a fastener with the screwdriver bit with some axial force that would move rod 16, valve stem 10, and valve body 9 into a position of "opening" the port 11 and chamber 8 to fluid power supply; however, the supply is blocked at valve body 2. The tool will not start until the operator activates the overriding valve actuator pin 26, valve stem 3, and valve body 2 into an open position.

The preferred design shown illustrates a claimed arrangement of the valve block 24 being oriented in common housing bore 50 and held in position therein by flat 29 being clamped by screw 32 having a seal 33 in threaded cross bore 47. The arrangement is unique in the multi-functional features of the valve block 24 that acts as a seat or stop for spring 17, valve seat for valve body 2, holder for seal 34, guide for valve stem 3, while being easily removable for service and adjustment of valve stem 10 relative to valve body 9.

Having described the invention, what is claimed is:

1. A valve construction for an automatic and a manual shut-off tool and the like comprising:

an elongated bore in the tool having disposed therein a first and second valve element accomplishing respectively manual and automatic shut-off of said tool, one of said valve elements cooperating with and guided by a valve body removably disposed from a one end in said elongated bore for shutting off fluid flow in said elongated bore in one operating mode, and said valve body being secured in said elongated bore by a fastener in a cross bore intersecting said elongated bore, and the other of said valve elements cooperating with the other end of said elongated bore to effect shut-off of fluid flow in said elongated bore in an alternative operating mode.

2. A valve construction for automatic and manual shut-off tools according to claim 1, wherein said tool generally comprises a cylinder having an axis and said elongated bore is an axial bore.

3. A valve construction for automatic and manual shut-off tools according to claim 1, wherein said elongated bore cooperates with a pressure fluid inlet at said one end of said elongated bore for receiving pressure fluid in said elongated bore.

4. A valve construction for automatic and manual shut-off tools according to claim 1, wherein said one of said valve elements is manually operated and said other of said valve elements is automatically operated at a predetermined torque output of said tool.

5. A valve construction for automatic and manual shut-off tools according to claim 1, wherein said one of said valve elements is located in the elongated bore having an operating element proximate said cross bore and is operable by a pin inserted in said cross bore.

6. A valve construction for automatic and manual shut-off tools according to claim 5, wherein said pin is inserted in a sleeve permitting radial translation of said pin in an extended portion of said cross bore and said pin is provided with a ramp for cooperating with and axially displacing said one of said valve elements upon selectively displacing said pin in said cross bore.

7. A valve construction for automatic and manual shut-off tools according to claim 1, wherein said other of said valve elements is located at said other end of said elongated bore and cooperates with a partially closed end of said elongated bore to form a valve seat and said other of said valve elements is operable through said valve seat.

8. A valve construction for automatic and manual shut-off tools according to claim 7, wherein said other of said valve elements is accessible and removable through said elongated bore through said pressure fluid inlet.

9. A valve construction for automatic and manual shut-off tools according to claim 3, wherein said pressure fluid inlet is secured to said elongated bore so as to form a closure thereof.

10. A valve construction for automatic and manual shut-off tools according to claim 9, wherein return springs are provided between said pressure fluid inlet and said one of said valve elements and said valve body and said other of said valve elements whereby assembly of said valve elements and positions of said valve body may be made from said one end of said elongated bore.

11. A valve construction for automatic and manual shut-off tools according to claim 10, wherein said cross bore is provided with venting means for bleeding pressure trapped between said valve elements to permit reset of said other of said valve elements after automatic shut-off.

12. A valve construction for automatic shut-off screwdriver comprising:

an elongated bore in the screwdriver having disposed therein a first and second valve element accomplishing respectively manual and automatic shut-off of said tool, one of said valve elements cooperating with and guided by a valve body removably disposed from a one end in said elongated bore for shutting off fluid flow in said elongated bore in one operating mode, and said valve body being secured in said elongated bore by a fastener in a cross bore intersecting said elongated bore between said first and said second valve element; and the other of said valve elements cooperating with the other end of said elongated bore to effect shut-off of fluid flow in said elongated bore in an alternative operating mode;

said elongated bore cooperates with a pressure fluid inlet at said one end of said elongated bore for receiving pressure fluid in said elongated bore;

said one of said valve elements is manually operated and said other of said valve elements is automatically operated at a predetermined torque output of said tool; and said one of said valve elements is located in said elongated bore and has an operating element proximate said cross bore and is operable by a pin inserted in said cross bore.

13. A valve construction for automatic shut-off screwdriver according to claim 12, wherein said pin is inserted in a sleeve permitting radial translation of said pin in an extended portion of said cross bore and said pin is provided with a ramp for cooperating with and axially displacing said one of said valve elements upon selectively displacing said pin in said cross bore; and said other of said valve elements is located at said other end of said elongated bore and cooperates with a partially closed end of said elongated bore to form a valve seat and said other of said valve elements is operable through said valve seat.

14. A valve construction for automatic shut-off screwdriver according to claim 12, wherein said other of said valve elements is accessible and removable through said elongated bore through said pressure fluid inlet; said pressure fluid inlet is secured to said elongated bore so as to form a closure thereof; and return springs are provided between said pressure fluid inlet and said one of said valve elements and said valve body and said other of the valve elements whereby assembly of said valve elements and positions of said valve body may be made from said one end of said elongated bore.

* * * * *